US006305146B1

(12) United States Patent
Gerber

(10) Patent No.: US 6,305,146 B1
(45) **Date of Patent: *Oct. 23, 2001**

(54) PROCESS FOR THE FINAL FOLDING AND SUBSEQUENT STORAGE OF A PIECE OF LINEN AND FINAL FOLDING MEANS

(75) Inventor: Samuel Gerber, Fraubrunnen (CH)

(73) Assignee: Jensen AG Burgdorf, Burgdorf (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/264,859

(22) Filed: Mar. 9, 1999

(51) Int. Cl.[7] ..... B65B 63/04

(52) U.S. Cl. ..... 53/116; 53/117; 53/120; 53/531; 493/437; 493/449

(58) Field of Search ..... 53/116, 117, 120, 53/529, 527, 531, 535, 466; 493/437, 449

(56) References Cited

U.S. PATENT DOCUMENTS

| | | | | |
|---|---|---|---|---|
| 3,493,226 | * | 2/1970 | Weir | 493/437 |
| 3,531,905 | * | 10/1970 | Omori | 53/535 |
| 3,681,891 | * | 8/1972 | Strycj | 53/466 |
| 3,837,466 | * | 9/1974 | Jones | 53/531 |
| 4,006,576 | * | 2/1977 | Tetenborg | 53/527 |
| 4,021,993 | * | 5/1977 | Widmer | 53/120 |
| 4,084,391 | * | 4/1978 | Williams, Sr. et al. | 53/120 |
| 4,099,363 | * | 7/1978 | Wistinghausen et al. | 53/529 |
| 4,134,330 | * | 1/1979 | Weickenmeier | 53/535 |
| 4,162,603 | * | 7/1979 | Stromberg | 53/529 |
| 4,472,923 | * | 9/1984 | Herrington | 53/120 |
| 4,617,780 | * | 10/1986 | Focke et al. . | |
| 4,738,078 | * | 4/1988 | Benz et al. | 53/466 |
| 4,757,667 | * | 7/1988 | Elsner . | |
| 5,113,639 | * | 5/1992 | Bryson . | |
| 5,187,922 | * | 2/1993 | Mast | 53/466 |
| 5,189,864 | * | 3/1993 | Cinotti et al. . | |
| 5,400,569 | * | 3/1995 | Jones et al. | 53/439 |
| 5,459,979 | * | 10/1995 | Tommasi . | |

FOREIGN PATENT DOCUMENTS

| | | | | |
|---|---|---|---|---|
| 2912397 | * | 10/1980 | (DE) | 53/120 |

OTHER PUBLICATIONS

Jensen Textile Jentex brochure, "The Extremely Universal and High Quality Textile Folder".

* cited by examiner

*Primary Examiner*—Eugene Kim
(74) *Attorney, Agent, or Firm*—Finnegan, Henderson, Farabow, Garrett & Dunner, L.L.P.

(57) ABSTRACT

To fold a piece of linen (5) to a very small final dimension, for example a bed sheet to 9"×6", said piece of linen is kept constantly under pressure after final folding until it has been fixed in a storage position, in order to prevent opening of said final fold. This can be effected by pushing it during final folding by means of a folding sword into a receptacle (20), from where it is pushed by means of a ram (26) onto a stacking line (27) where its outer surfaces each rest against a corresponding outer surface of an adjacent piece of linen (5') or another stop surface formed by slides (31*a,b*) or a pressure plate (33), so that it is fixed in its final configuration. Alternatively, the piece of linen can be fed, while maintaining pressure on the outer surfaces, to a packing apparatus and surrounded there by a strip of packaging material.

28 Claims, 5 Drawing Sheets

PROCESS FOR THE FINAL FOLDING AND SUBSEQUENT STORAGE OF A PIECE OF LINEN AND FINAL FOLDING MEANS

FIELD OF THE INVENTION

The invention relates to a process for the final folding and subsequent storage of a piece of linen according to the preamble of Claim 1 and a final folding apparatus according to the preamble of Claim 6 or 10. A known process of the generic type and such a final folding means are described, for example, in the brochure JENSEN TEXTILE JENTEX from AKAB of Sweden AB, Bussgatan 4, SE-504 94 and from Jensen AG Burgdorf, CH-3400 Burgdorf.

PRIOR ART

The known process of the generic type is suitable for folding a piece of linen to a specific final dimension where the weight of the parts themselves is sufficient to hold the piece of linen in the final configuration achieved. Recently, however, especially with regard to the desire for the folded pieces of linen to occupy a small area in deliveries and the like, requirements are set with respect to the final dimension which can no longer be met by automatic folding in a conventional manner since the pieces of linen folded very small immediately open again, completely or partly eliminating the final folding.

Folds to such final dimensions have therefore been carried out manually to date, which however requires considerable effort owing to the high folding pressure to be applied and the required control over the piece of linen until storage or intermediate storage.

SUMMARY OF THE INVENTION

It is the object of the invention to develop the known process of the generic type so that it permits automatic final folding of a piece of linen to a small final dimension. This object is achieved by the features in the characterizing clause of Claim 1. In addition, the known apparatus of the generic type is to be further developed so that it is suitable for carrying out final folding to small final dimensions. This object is achieved by the features in the characterizing clause of Claim 6 or 10.

The advantages achieved by the invention are that pieces of linen can be automatically folded to very small final dimensions and can be brought to a stable storage position. In particular, for example, bed sheets can be folded to 9"×6" so that they require a very small area.

BRIEF DESCRIPTION OF THE DRAWINGS

The invention is illustrated in more detail below with reference to FIGS. which merely represent embodiments.

DESCRIPTION OF THE PREFERRED EMBODIMENTS

Figure 1A:
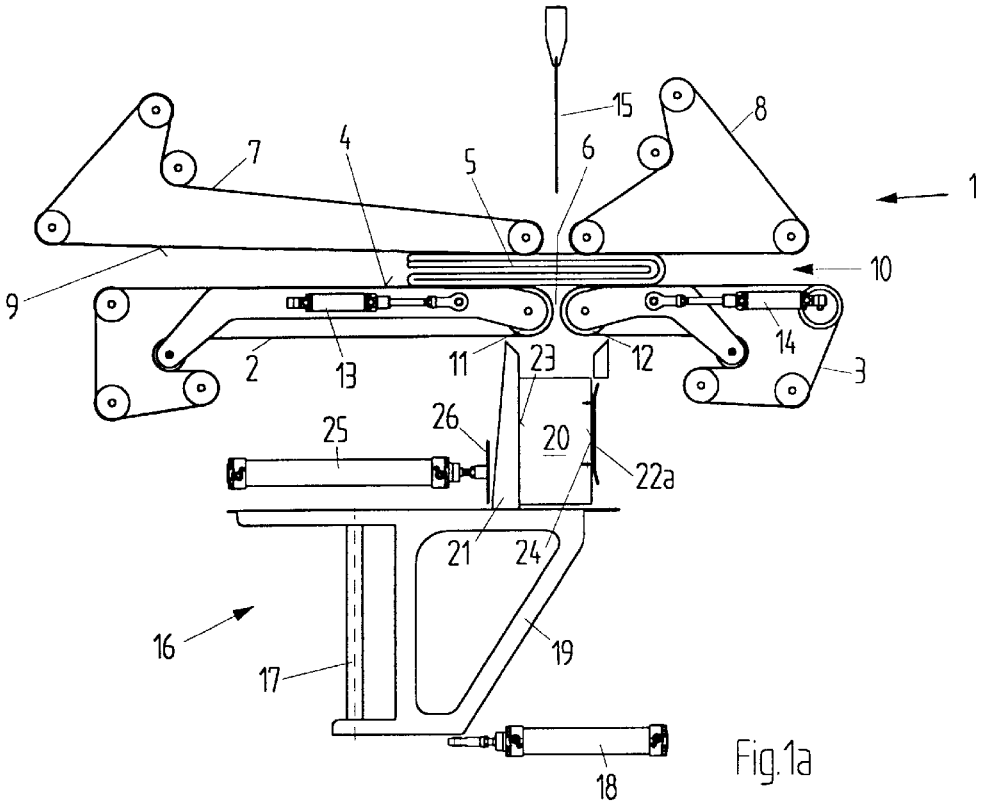
FIG. 1*a* shows a side view of a novel final folding means according to a first embodiment of the invention, in a first phase of final folding with subsequent stacking.

According to a first embodiment, the final folding station according to the invention comprises a folding apparatus 1 having a first draw-in belt 2 and a second draw-in belt 3 whose upper belt sides form an upwardfacing draw-in surface 4 for receiving a piece of linen 5, which draw-in surface is interrupted by a gap 6. Arranged above the conveying surface 4 are two guide belts 7, 8 whose lower belt sides form a guide surface 9 which is parallel to the draw-in surface 4 and is likewise interrupted above the gap 6. The draw-in surface 4 and the guide surface 9 between them form a draw-in channel 10.

Rollers 11, 12, over which the draw-in belts 2, 3 are guided at the gap 6, can be pulled back from a starting position of the final folding means (FIG. 1*a*) by pneumatic cylinders 13, 14 for widening the gap 6. A folding sword 15, likewise in the starting position, is arranged above the guide belts 7, 8. It can be lowered through the gap in the guide surface 9 and the gap 6 underneath in the draw-in surface 4, by an actuating device which is not shown.

A transfer device 16 is arranged below the folding apparatus 1. Said transfer device comprises a frame 19 which can be rotated about a perpendicular axis 17 by means of a pneumatic cylinder 18 and which carries a receptacle 20 which is a distance away from the axis 17 and, in the starting position, is arranged directly below the gap 6 and is parallel to it. It is bounded by a back panel 21 and two wings 22*a, b* which are arranged a distance away from said back panel, can be folded away outwards about perpendicular axes against elastic forces and form approximately parallel stop surfaces 23 and 24, respectively, which face one another and may diverge slightly from one another at the upper edges. Behind the back panel 21 and fastened to the frame 19 is a further pneumatic cylinder 25 whose piston carries a disc-shaped ram, alternatively referred to as a "first stacking member," which when in the starting position, is present behind the back panel 21 and can be moved forward through a round opening in said back panel and between the wings 22*a,* 22*b.*

The frame 19 can be swivelled from the starting position about the axis 17 into a transfer position (FIGS. 1*c*, 2*a*), in which a stacking line 27 (FIGS. 2*a–c*, omitted in FIGS. 1*a–c*) directly adjoins the receptacle 20. Said stacking line has a sliding plate 28, alternatively referred to as a "second stacking member," and lateral guide plates 29*a, b* which together bound a stacking channel 30 which declines slightly towards the receptacle 20. The stacking channel 30 is closed off from the receptacle 20 in a starting position (FIG. 2*a*) by two slides 31*a, b* which are provided in the middle with semicircular recesses and can be laterally retracted by means of two pneumatic cylinders 32*a, b.* On the opposite side, it is bounded by a pressure plate 33 which can be moved with application of a certain pressure towards that end of the stacking line 27 which is opposite the receptacle 20. The transfer device 16 may also be formed in such a way that is can assume a plurality of transfer positions characterized by various angles of rotation of the frame 19 relative to the axis of rotation 17 and from which positions the stacking lines, which may be formed identically to the stacking line described, radiate outwards in a star-like manner.

Figure 1B:
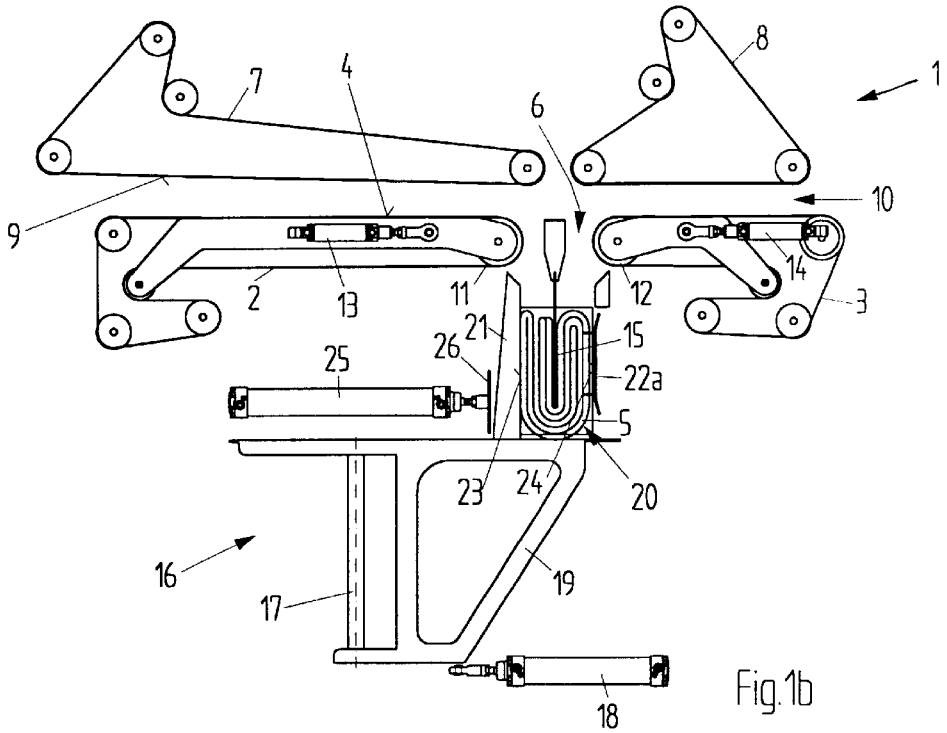
FIG. 1*b* shows a side view corresponding to FIG. 1*a,* with the final folding means in a second phase of final folding with subsequent stacking.
Figure 1C:
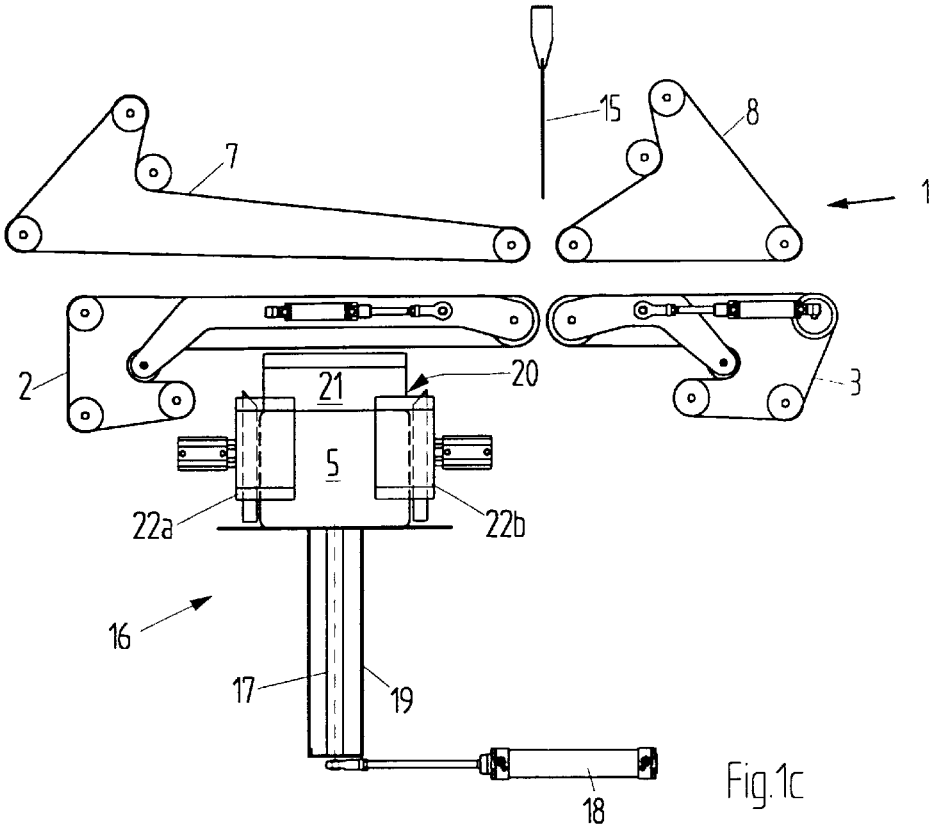
FIG. 1*c* shows a side view corresponding to FIG. 1*a,* with the final folding means in a third phase of final folding with subsequent stacking.

The final folding means shown in FIGS. 1*a–c,* 2*a–c* may be formed as an independent module which connects with a folding station of a known type. The piece of linen 5 arriving from the folding station, for example a bed sheet which was brought to a size of 9"×12" by being folded several times, is drawn into the draw-in channel 10 at the left end of the final folding means by corresponding movement of the first draw-in belt 2 and of the first guide belt 7 and, finally also by means of the second draw-in belt 3 and of the second guide belt 8, is moved to the right until its middle is located exactly above the gap 6 and below the folding sword 15 (FIG. 1*a*).

Final folding is then formed by widening the gap 6 by slightly pulling apart the rollers 11, 12 and lowering the folding sword 15 through said gap and thus pressing the piece of linen 5 so that the middle of its lower side moves downwards into the receptacle 20, while at the same time its laterally connecting parts are folded back by contact with the stop surfaces 23, 24 so that they form parallel outer surfaces of the finally folded piece of linen 5, which now has final dimensions of 9"×6". Opening of the piece of linen 5 is prevented by the further action of the stop surfaces 23, 24, which exert forces of reaction which are directed at the outer surfaces towards the middle of the receptacle 20. The piece of linen 5 is therefore held by said forces in the final configuration achieved, against its tendency to unfold again (FIG. 1*b*).

Figure 2A:
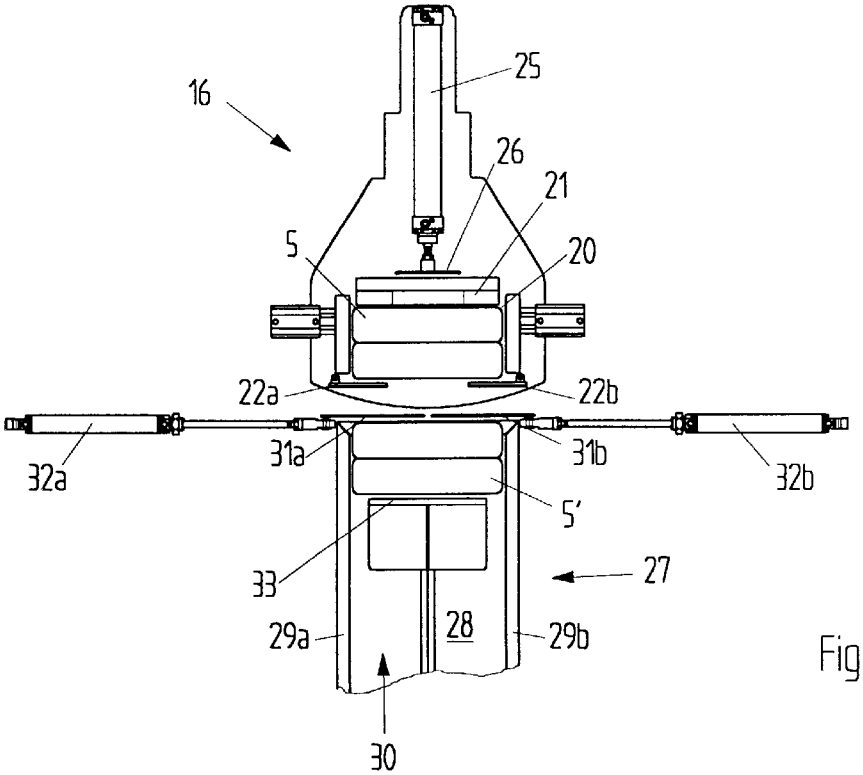
FIG. 2*a* shows a plan view of the final folding means of FIG. 1*c,*
Figure 2B:
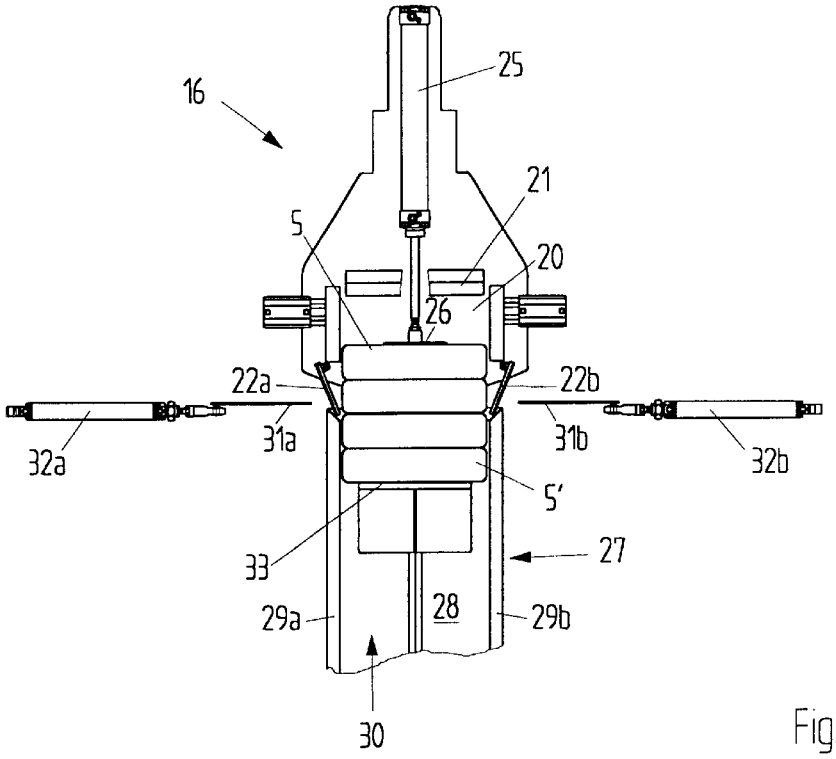
FIG. 2*b* shows a plan view corresponding to FIG. 2*a,* with the final folding means in a fourth phase of final folding with subsequent stacking.
Figure 2C:
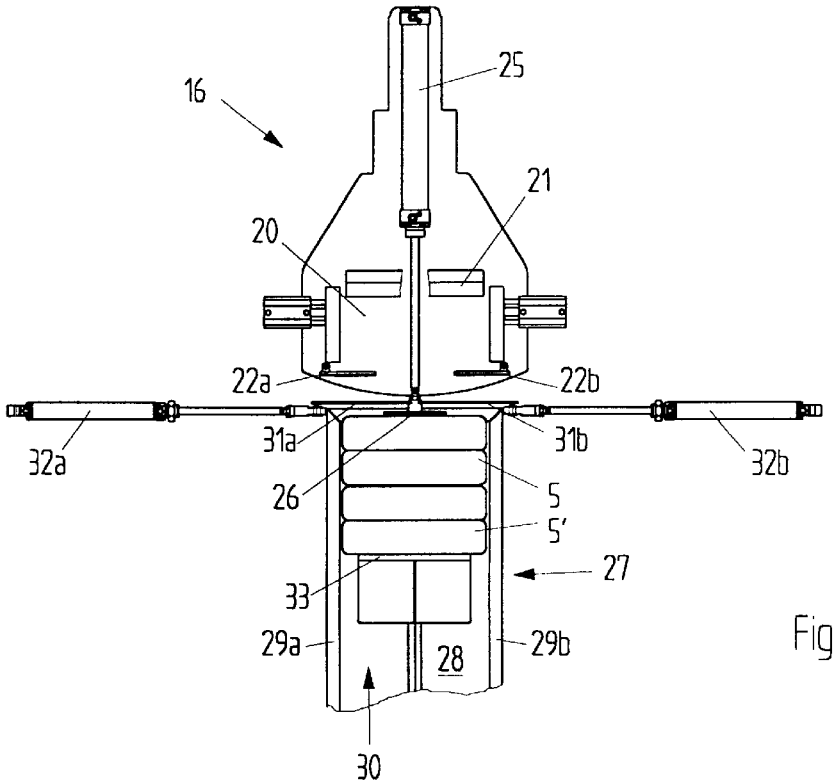
FIG. 2*c* shows a plan view corresponding to FIG. 2*a,* with the final folding means in a fifth phase of final folding with subsequent stacking.

The frame 19 is then rotated by means of the pneumatic cylinder 18 through 90° to a transfer position so that the receptacle 20 is now directly opposite one end of the stacking line 27 (FIGS. 1*c*, 2*a*). After retraction of the slides 31*a,b,* the piece of linen 5 can then be pushed into the stacking channel 30 by advancing the ram 26 while the wings 22*a,b* swivel away laterally (FIG. 2*b*), after which the slides 31*a,b* travel back to the starting position (FIG. 2*c*). The ram 26 can then be withdrawn through the circular opening formed by the recesses in the slides 31*a,b* and further between the wings 22*a,b* and through the opening in the back panel 21.

The finally folded piece of linen 5 is now in a storage position in which it rests with one of its outer surfaces against a corresponding outer surface of a previously finally folded piece of linen 5', and with its opposite outer surface, parallel to the first-mentioned outer surface, against the slides 31*a,b.* It is obvious that the two outer surfaces of a piece of linen each rest against an outer surface of an adjacent piece of linen or against another stop surface formed by the slides 31*a,b* or the pressure plate 33. Consequently, each piece of linen is fixed in its final configuration in this storage position and opening of the final fold cannot occur. When stacking line 27 is full, or even earlier, the stack as a whole can be removed and, for example, packed. If a plurality of stacking lines and corresponding transfer positions are present, the latter can be approached, for example, alternately so that the stacking lines are filled uniformly.

According to a second embodiment, the final folding means according to the invention once again comprises a folding apparatus 1 which, with draw-in belts 2, 3 and guide belts 7, 8, whose upper and lower belt sides form a draw-in surface 4, interrupted by a gap 6, and a corresponding guide surface 9, which enclose a draw-in channel 10, and, with a folding sword 15, essentially corresponds to the folding apparatus of the final folding means according to the first embodiment. However, the draw-in channel 10 slopes upwards and the folding sword 15 is inclined in the draw-in direction of the piece of linen 5. In addition, only the roller 11, over which the first draw-in belt 2 runs, is displaceable for changing the width of the gap 6, but not the opposite roller 12. A horizontal feed belt 34 is arranged upstream of the first draw-in belt 2.

Present directly below the gap 6 is a folding belt 35 which slopes slightly downwards and whose upper belt side forms, with that belt side of the second draw-in belt 3 which runs above said folding belt, a folding channel 36 which extends to the end of the folding apparatus 1. The folding apparatus 1, as well as a subsequent packing apparatus 37, is in the form of an independent transportable station.

The packing station 37 has, at the entrance, an approximately horizontal first transfer belt 38 whose upper belt side, together with that lower belt side of an upper transfer belt 39 which runs parallel above said upper belt side, bounds a transfer channel 40 which is directly adjacent to the folding channel 36 and leads to a packing channel 41 which is likewise virtually directly adjacent and is present between an upper belt side of a first packing belt 42 and that belt side of a second packing belt 43 which runs parallel above said first packing belt. The widths of the transfer channel 40 and of the packing channel 41 correspond approximately to the width of the folding channel 36.

Arranged below the first packing belt 42 and above the second packing belt 43 are storage rollers 44 and 45, respectively, which each carry a web 46 and 47, respectively, of a strip-like weldable packaging material, for example a plastics film, which is guided over a guide roller 48 or 49, respectively, arranged upstream of the first packing belt 42 and of the second packing belt 43, respectively, into the packing channel 41, where it is present between the first packing belt 42 or the second packing belt 43 and any piece of linen 5. Arranged directly behind the end of the packing channel 41 is a connecting device having two heatable welding stamps 50, 51 which can be advanced towards one another perpendicularly to the middle of the packing channel 41 and which is followed by a delivery belt 52 at the height of the first packing belt 42.

Figure 3A:
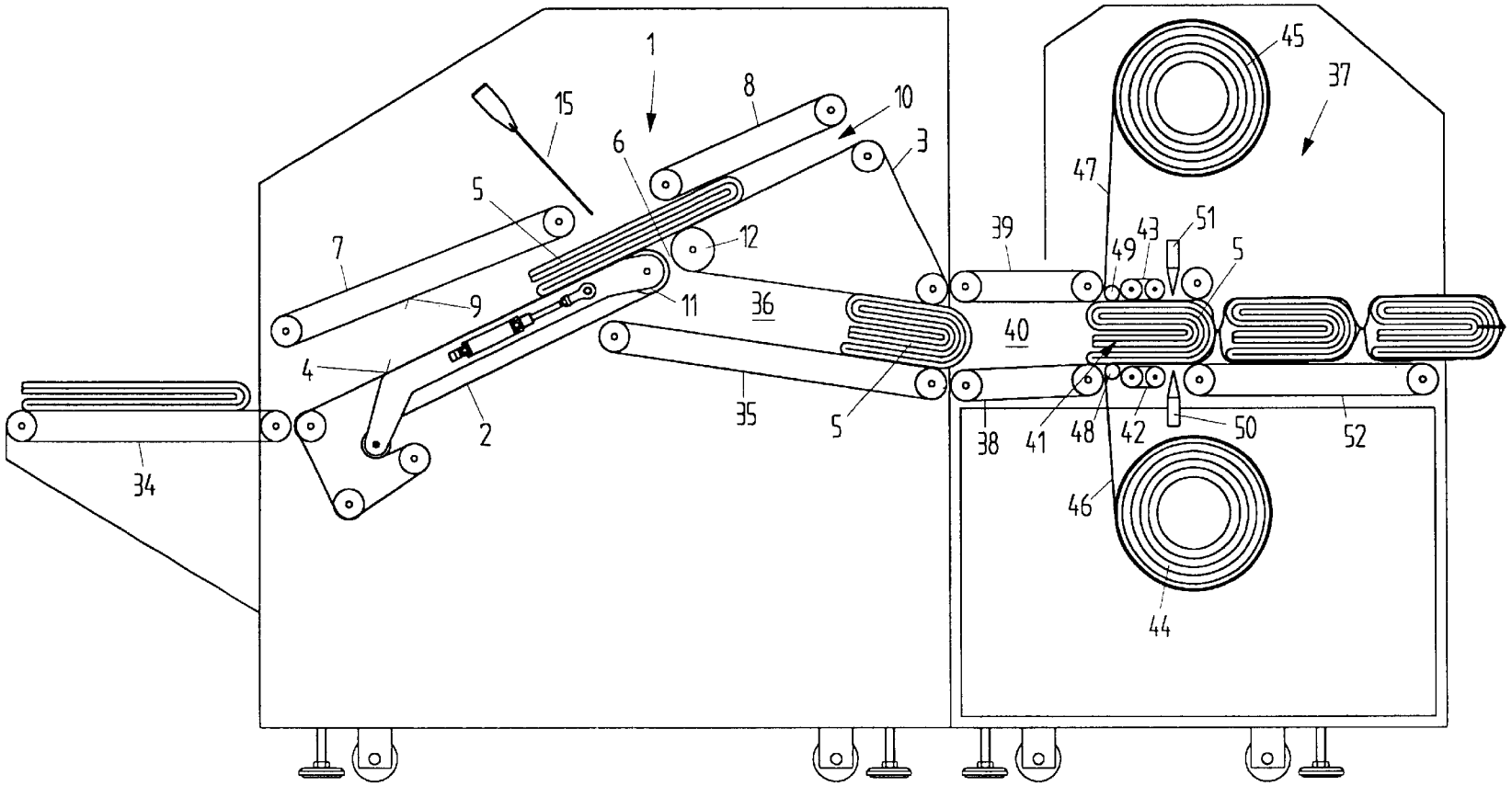
FIG. 3*a* shows a side view of a novel final folding means according to a second embodiment of the invention, in a first state

A piece of linen 5 placed on the feed belt 34 or arriving from an upstream folding apparatus is drawn into the draw-in channel 10 at the left end of the final folding means by corresponding movement of the first draw-in belt 2 and of the first guide belt 7 and, finally also by means of the second draw-in belt 3 and of the second guide belt 8, is moved to the right until its middle is present above the gap 6 and inclined below the folding sword 15 (FIG. 3*a*).

Figure 3B:
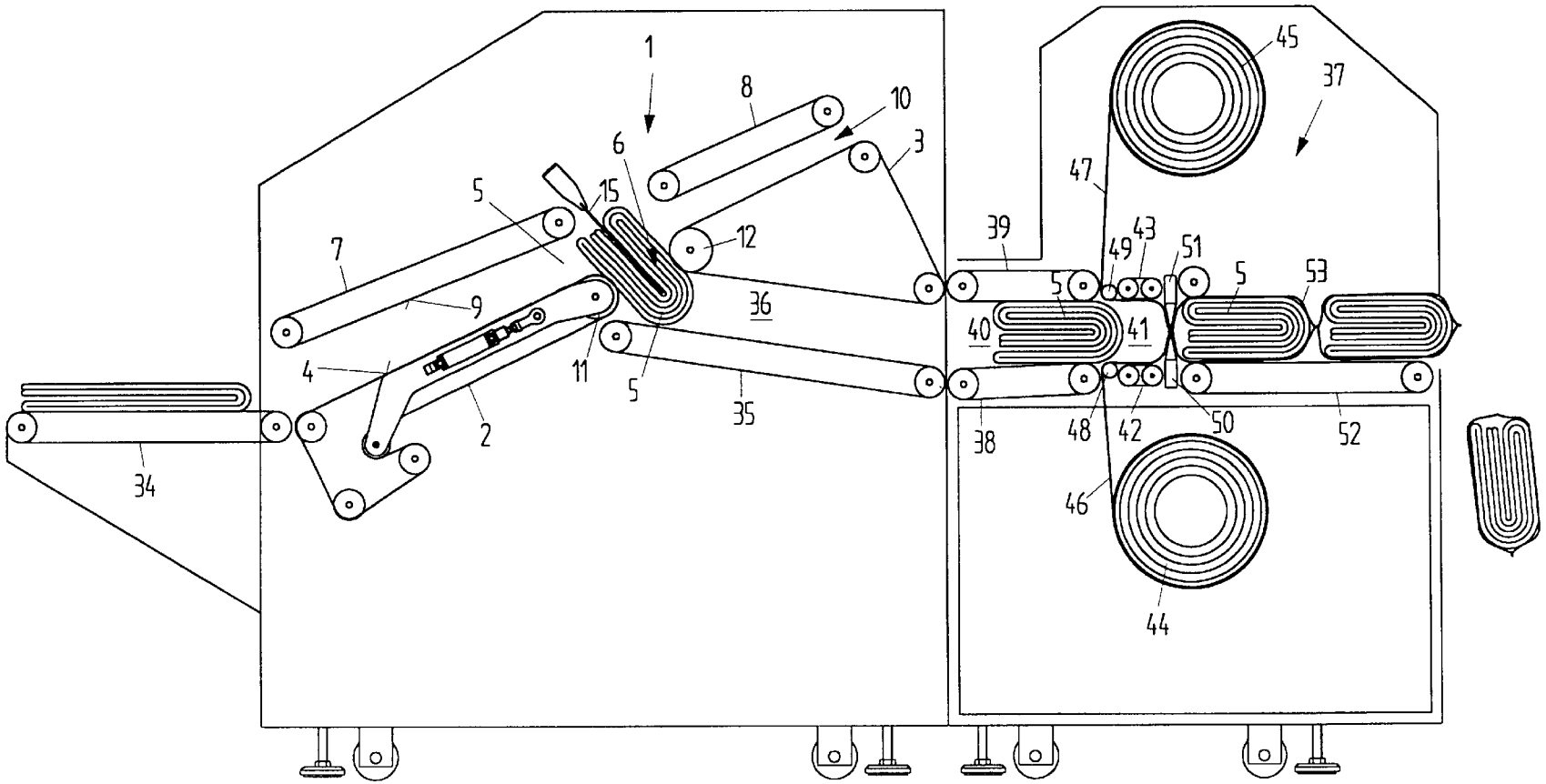
FIG. 3*b* shows a side view corresponding to FIG. 3*a,* with the final folding station in a second state.

The final fold is then performed by widening the gap 6 by slightly drawing back the roller 11 and by moving the folding sword 15 through said gap obliquely downwards and thus pushing the piece of linen 5, with the middle of its lower side facing forwards, into the folding channel 36. The second draw-in belt 3 and the folding belt 35 are moved in such a way that they accompany and support the movement of the piece of linen 5 (FIG. 3*b*). This movement of said belts is maintained until the piece of linen 5 leaves the folding apparatus 1 at the end of the folding channel 36, while the folding sword 15 is withdrawn (FIG. 3*a*).

The piece of linen 5 now enters the transfer channel 40 of the packing apparatus 37, where it is transported onwards by corresponding movement of the first transfer belt 38 and of the second transfer belt 39 and is finally pushed into the packing channel 41 between the webs 46, 47 of packaging material (FIG. 3*b*). Once it has reached the end of the packing channel 41, the contact with the first transfer belt 38 and with the second transfer belt 39 ceases and the piece of linen abuts a weld seam which is made by means of the welding stamps 50, 51 and joins the webs 47, 48. After withdrawal of the welding stamps 50, 51, the packing belt s 42, 43 are set in motion so that, with simultaneous withdrawal of packaging material from the storage rollers 44, 45, the piece of linen 5 is transported out of the packaging channel 41 and reaches the delivery belt 52. In this position, the welding stamps 50, 51 are advanced and the webs 47, 48—now behind the piece of linen 5—are welded again (FIG. 3*b*).

The piece of linen 5 has now been brought to a storage position in which it is surrounded by a closed strip 53 of packaging material which consists of two part-strips which are formed from sections of the webs 46, 47 and are connected by two weld seams. The part-strips now exert forces of reaction on the parallel outer surfaces of the piece of linen 5, which forces are directed towards one another and once again prevent opening of the final fold and fix the piece of linen 5 in its final configuration. It is possible to provide further welding stamps, by means of which lateral weld seams joining the part-strips are additionally made, so that said weld seams result in completely closed packaging of the piece of linen. In this case, the webs of packaging material must of course be correspondingly broader than the piece of linen, whereas, in the case described above, they preferably have about the same width but may also be narrower. After further transport on the delivery belt 52, the packed pieces of linen are ejected, whereupon they are separated at the weld seams.

What is decisive for carrying out the process successfully, if it is to be effective on the final folding means according to the first or that according to the second embodiment, is that, after the final folding, pressure is maintained constantly on the parallel outer surfaces of each piece of linen until the latter has been fixed in its final configuration by stacking or packing or in another manner, in a storage position. In the first case, this is effected essentially by the stop surfaces of the receptacle, and in the second case essentially by the transfer belts.

LIST OF REFERENCE SYMBOLS

1 Folding apparatus
2 First draw-in belt
3 Second draw-in belt
4 Draw-in surface
5 Piece of linen
6 Gap
7 First guide belt
8 Second guide belt
9 Guide surface
10.Draw-in channel
11, 12 Rollers
13, 14 Pneumatic cylinders
15 Folding sword
16 Transfer device
17 Axis
18 Pneumatic cylinder
19 Frame
20 Receptacle
21 Stop plate
22*a,b* Wings
23, 24 Stop surfaces
25 Pneumatic cylinder
26 Ram
27 Stacking line
28 Sliding plate
29*a,b* Guide plates
30 Stacking channel
31*a,b* Slides
32*a,b* Pneumatic cylinders
33 Pressure plate
34 Feed belt
35 Folding belt
36 Folding channel
37 Packing station
38, 39 Transfer belts
40 Transfer channel
41 Packing channel
42, 43 Packing belts
44, 45 Storage rollers
46, 37 Webs of packaging material
48, 49 Guide rollers
50, 51 Welding stamps
52 Delivery belt
53 Strip

What is claimed is:

1. An apparatus for folding articles comprising:

a draw-in surface defining a gap shaped to receive an article having first and second sides extending along a first direction;

a folding member configured to move between a retracted position and an extended position so as to place the article in a folded state where the first and second sides are folded about a fold line and extend along a second direction substantially perpendicular to the first direction; and a transfer mechanism pivotally oriented relative to the gap and the folding member so as to move between a receiving position where the transfer mechanism receives the article in the folded state and a transfer position, and having a receptacle configured to receive the folded article when the folding member moves to the extended position; and wherein the receptacle includes parallel first and second surfaces configured to hold the article in the folded state while the transfer mechanism moves from the receiving position to the transfer position, the second surface being movable relative to the first surface between an engaged position where the second surface of the receptacle compresses the second side of the article about the fold line, and a disengaged position where the second surface of the receptacle allows the article to be transferred away from the receptacle.

2. The apparatus of claim 1, wherein the transfer mechanism further comprises a ram configured to be advanced from a rest position in which the ram is not extended beyond the plane of the first surface in a direction toward the second surface.

3. The apparatus of claim 1, wherein the transfer mechanism is rotatable about an axis approximately perpendicular to the plane of the draw-in surface.

4. The apparatus of claim 1, further comprising a stacking mechanism disposed adjacent to the transfer mechanism.

5. The apparatus of claim 4, wherein the stacking mechanism comprises a stacking line, and a pressure plate configured to engage a piece of folded linen received from the transfer mechanism and to be displaced in a direction away from the transfer mechanism.

6. The apparatus of claim 5, wherein the pressure plate is configured to be displaced in response to a sufficient force applied thereto.

7. The apparatus of claim 1, wherein the transfer mechanism is configured to receive the article in the folded state when the folding member moves from the retracted position to the extended position.

8. The apparatus of claim 2, wherein the ram is configured to push the article away from the folding member while the article is held in the folded state.

9. The apparatus of claim 1, wherein the second surface of the receptacle is configured to pivot when the article is transferred away from the folding member.

10. An apparatus for folding articles comprising:

a draw-in surface defining a gap shaped to receive an unfolded article having first and second surfaces;

a folding member configured to move between a retracted position outside of the gap and an extended position inside the gap to place the article in a folded state where the first and second surfaces are folded about a fold line;

a folding channel in communication with the gap and extending from a side of the draw-in surface opposite to the folding member in a retracted position, the folding channel configured to receive an article in the folded state from the folding member and maintain the article in the folded state by compressing the second surface of the article;

a packing mechanism comprising first and second parallel packing belts defining a packing channel having a width approximately corresponding to a width of the folding channel, said packing channel being configured to maintain the article in the folded state by compressing the second surface of the article about the fold line and to receive a web of packaging material along each of the packing belts to wrap around the article while the article is maintained in the folded state; and a connecting mechanism disposed downstream of the packing belts and configured to connect the webs to each other on either side of the article while the article is maintained in the folded state.

11. The apparatus of claim 10, further comprising a transfer channel having a width approximately corresponding to the width of the folding channel and connecting the folding channel to the packing channel with essentially no interruption.

12. The apparatus of claim 11, wherein the transfer channel maintains the article in the folded state while the article is transferred from the folding channel to the packing channel.

13. An apparatus for folding articles comprising:

a draw-in surface defining a gap for receiving an article having first and second surfaces;

a folding member configured to advance from a retracted position outside the gap to a folding position in the gap so as to place the article in a folded state where the first and second surfaces are folded about a fold line;

a transfer mechanism, aligned with the gap and disposed on a side of the draw-in surface opposite to the folding member in the retracted position, said transfer mechanism being configured to receive the article from the draw-in surface and to maintain the article in the folded state;

a stacking mechanism disposed adjacent to the transfer mechanism and configured to receive the article from the transfer mechanism while maintaining the article in the folded state, the stacking mechanism being configured to receive a series of articles so as to form a stack of articles, said stacking mechanism including a pressure exerting mechanism configured to compress each of the series of articles forming the stack in a direction toward the transfer mechanism so as to maintain each of the articles in the folded state; and wherein said pressure exerting mechanism is displaceable in a direction opposite from the stack in response to a sufficient pressure on the pressure exerting mechanism so as to allow each of the articles in the stack to move along a stacking line while being maintained in the folded state.

14. The apparatus of claim 13, wherein the transfer mechanism includes an ejection mechanism for ejecting the folded material from the transfer mechanism to the stacking mechanism.

15. The apparatus of claim 14, wherein the ejection mechanism includes a ram disposed on an opposite side of the folded material as the pressure exerting mechanism.

16. The apparatus of claim 15, wherein the ram of the ejection mechanism is configured to push an article received in the transfer mechanism onto the stacking line while displacing the pressure exerting member along the stacking line.

17. The apparatus of claim 16, wherein the pressure exerting mechanism comprises a sliding plate configured to move along the stacking line in response to the sufficient pressure exerted by the ram of the ejection mechanism on the pressure exerting member.

18. The apparatus of claim 15, wherein the transfer mechanism includes a back panel and a wing configured to maintain the article in the folded state by compressing the first and second surfaces of the article about the fold line.

19. The apparatus of claim 18, wherein the wing of the transfer mechanism is arranged to pivot when the ram of the ejection mechanism pushes the article onto the stacking line.

20. An apparatus for folding articles, comprising:

a draw-in surface defining a gap for receiving an article having first and second sides;

a folding member configured to move between a retracted position and an extended position inside the gap so as to place the article in a folded state, where the first and second sides are folded about a fold line;

a transfer mechanism, aligned with the gap and disposed on a side of the draw-in surface opposite to the folding member in the retracted position, said transfer mechanism being configured to receive the article while in the folded state from the draw-in surface;

a stacking mechanism disposed adjacent to the transfer mechanism and configured to receive the article from the transfer mechanism while maintaining the article in the folded state, and wherein the stacking mechanism receives a series of articles each in the folded state so as to form a stack of folded articles, and said stacking mechanism including a pressure exerting mechanism configured to compress each of the articles forming the stack in a direction toward the transfer mechanism and in a direction perpendicular to a folding direction of the folded material so as to maintain each of the stacked articles in the folded state.

21. The apparatus of claim 20, wherein said pressure exerting mechanism includes a pressure plate.

22. The apparatus of claim 21, wherein said pressure plate is displaceable in a direction away from the transfer mechanism.

23. An apparatus for folding pieces of material comprising:

at least one support surface defining a folding gap for receiving a piece of material having first and second surfaces;

a folding device having a folding blade pivotally supported to move between a first position and a second position inside the folding gap so as to place the piece of material in a folded state, where the first and second surfaces of the piece of material are folded about a fold line; and a transfer device arranged to move between a receiving position, where the transfer mechanism receives the piece of material from the folding device and a transfer position, where the piece of material is transferred away from the transfer device, the transfer device including a receptacle having a back panel and at least one wing configured to receive the piece of material and maintain the piece of material in the folded state continuously when the transfer mechanism moves between the receiving position and the transfer position and wherein the wing is arranged to maintain the second surface of the piece of material folded about the fold line when the piece of material is received in the receptacle of the transfer device and move away from the back panel of the receptacle when the piece of material is transferred away from the transfer device.

24. The apparatus of claim 23, wherein the wing of the receptacle is biased relative to the back panel of the receptacle.

25. The apparatus of claim 23, wherein the transfer device further includes a ram configured to move the piece of material away from the back panel of the receptacle while displacing the wing of the receptacle along the stacking line.

26. The apparatus of claim 23, further comprising a stacking device configured to receive the piece of material from the transfer device, the stacking device including a stacking channel extending along a stacking line arranged to stack a plurality of pieces of material, and a sliding plate configured to compress the second surface of the piece of material about the fold line.

27. The apparatus of claim 25, wherein the transfer device includes a ram configured to move a piece of material received in the receptacle away from the back panel of the receptacle while displacing the wing of the receptacle.

28. The apparatus of claim 25, wherein the sliding plate of the stacking device is configured to maintain first and second pieces of material each in the folding state by compressing the first and second pieces of material, while allowing the first and second pieces of material to move along the stacking line when the ram of the transfer device pushes the second piece of material onto the stacking line.

* * * * *